United States Patent [19]

Nametkin et al.

[11] 4,132,631

[45] Jan. 2, 1979

[54] PROCESS FOR PETROLEUM REFINING

[76] Inventors: Nikolai S. Nametkin, Leninsky prospekt, 13, kv. 11, Moscow; Mikhail S. Matveev, ulitsa Shkolnaya, 3, kv. 12, Kstovo Gorkovskoi oblasti; Sergei P. Gubin, ulitsa Ostrovityanova, 21, kv. 114, Moscow; Abram S. Dekhterman, ulitsa Shkolnaya, 7, kv. 3, Kstovo Gorkovskoi oblasti; Vladimir D. Tjurin, Leninsky prospekt, 67, kv. 33, Moscow; Anatoly P. Skibenko, ulitsa Shkolnaya, 5, kv. 20, Kstovo Gorkovskoi oblasti; Valentina S. Orlova, ulitsa Mira, 25a, kv. 4, Kstovo Gorkovskoi oblasti; Alevtina I. Savenko, ulitsa 40 let Oktyabrya, 17a, kv. 52, Kstovo Gorkovskoi oblasti; Irina P. Podolskaya, Lomonosovsky prospekt, 7, korpus 1, kv. 39, Moscow, all of U.S.S.R.

[21] Appl. No.: 763,039

[22] Filed: Jan. 27, 1977

Related U.S. Application Data

[63] Continuation of Ser. No. 577,466, May 14, 1975, abandoned.

[30] Foreign Application Priority Data

May 17, 1974 [SU] U.S.S.R. ..... 2023702

[51] Int. Cl.[2] ..... C10G 29/04; C10G 7/00

[52] U.S. Cl. ..... 208/236; 208/237; 208/243; 208/244; 208/249; 208/254 R

[58] Field of Search ..... 208/254 R, 254 H, 237, 208/240, 243, 244, 249, 236, 238, 257

[56] References Cited

U.S. PATENT DOCUMENTS

| | | | |
|---|---|---|---|
| 2,306,933 | 12/1942 | Burk | 208/236 |
| 2,615,831 | 10/1952 | Bishop et al. | 208/244 |
| 3,865,715 | 2/1975 | Nametkin et al. | 208/243 |

*Primary Examiner*—George Crasanakis
*Attorney, Agent, or Firm*—Holman & Stern

[57] ABSTRACT

A process for petroleum refining to obtain petroleum products having a reduced content of sulphur, oxygen- and nitrogen-containing compounds which comprises introducing into the petroleum during distillation volatile and nonvolatile carbonyl compounds of transition metals selected from the group consisting of Cr, V, Mo, W, Mn, Re, Fe, Co, Ni in amounts of from 0.02 to 0.2% by weight of the petroleum at a temperature ranging from 150° to 350° C under a pressure of from 1 to 7 atm abs. and distilling the petroleum into the desired products.

Gasoline and kerosene resulting from such processing have a 5 to 10 times reduced content of mercaptan sulphur and 2 to 10 times reduced total sulphur content, as well as a reduced content of gums.

3 Claims, 4 Drawing Figures

PROCESS FOR PETROLEUM REFINING

This is a continuation of application Ser. No. 577,466, filed May 14, 1975, now abandoned.

BACKGROUND OF THE INVENTION

The present invention relates to processes for petroleum refining and, more specifically, to processes for petroleum refining to obtain petroleum products having a reduced content of sulphur, oxygen- and nitrogen-containing compounds.

Petroleum and primary refinery products such as gasoline and kerosene are extensively used as fuel components for internal combustion engines, as well as for jet and diesel fuels, fuel oils and starting stock for catalytical cracking.

Gasoline, kerosene, and diesel fuel produced from high-sulphur-content crudes and medium-sulphur content crudes contain total and mercaptan sulphur. For example, mercaptan content in kerosene may be as high as 0.008% by weight although the tolerable content is at most 0.005% by weight. The increased content of sulphur and sulphur compounds substantially impairs the service properties of petroleum products, resulting in reduced motor service life due to accelerated wear of vital parts and decreasing the economic efficiency thereof. In addition, increased sulfur content contributes to increased air pollution by producing acidic combustion products.

Reactive nitrogen- and oxygen-containing resin-forming compounds as well as naphthenic acids cause a reduced fuel stability upon storage due to formation of gums.

Various processes, for the removal of sulphur and sulphur compounds, contemplating treatment of products resulting from petroleum refining such as by treatment with sulphuric acid, adsorbents, hydrofining and the like are known in the art. In those prior art processes, as a rule, petroleum is first subjected to distillation, and thereafter each individual fraction is treated. However, from an economic point of view it is preferred to perform distillation and purification in one technological step.

A known process for desulfurization of hydrocarbons (U.S. Pat. No. 2,306,933) involves removing hydrogen sulphide, heating the petroleum separating the light and heavy fraction, treating the heavy fractions using conditions which facilitate formation of mercaptans at temperatures up to 204.4° C. (400° F.) by means of a reagent to convert non-mercaptan sulphur to mercaptans. This treatment is followed by reacting the heavy fraction with a metal carbonyl at a temperature of from 148.9° to 343° C. (300° to 650° F.) and separating any unreacted metal carbonyl.

Also known in the art is a process for purifying products resulting from petroleum refining to remove sulphur, sulphur compounds, reactive nitrogen- and oxygen-containing compounds and naphthenic acids (Belgian Patent No. 809,377) which process comprises purifying petroleum or its primary refinary products with compounds of transition metals at a temperature of from 80° to 120° C. Suitable transition metal compounds include volatile carbonyl compounds of transition metals, $\pi$-complexes of transition metals, salts or $\pi$-allyl complexes of metals of the platinum group, and carbonyl complexes of transition metals. As a result, a reaction mixture is obtained from which the desired purified product is isolated. This process is also applicable to the refining of crude petroleum. However, when used to refine crude petroleum, the process is practiced in two stages: purification treatment of crude petroleum and its subsequent distillation. Although this process is one of the most efficient known, it has some disadvantages. Its principal disadvantage resides in its use of volatile reagents for the purification which may accumulate in the final products, thus requiring the use of additional chelating agents to eliminate said reagents from the final products. All the above-described processes are applicable only to purification treatment of petroleum fractions, i.e. to products of petroleum refining, not to purification of crude petroleum and, therefore are incompatible with petroleum distillation.

SUMMARY OF THE INVENTION

It is an object of the present invention to provide a one-stage petroleum refining process which is characterized by a combination of distillation and purification stages while ensuring the production of high-quality petroleum products.

This and other objects of the present invention are accomplished by a process for petroleum refining resulting in the production of petroleum products with a reduced content of sulphur and oxygen- and nitrogen-containing compounds, wherein volatile and non-volatile carbonyl compounds of transition metals selected from the group consisting of V, Cr, Mo, W, Mn, Re, Fe, Co, Ni are fed into the petroleum being distilled in an amount ranging from 0.02 to 0.2% by weight of the petroleum at a temperature within the range of from 150° to 350° C. under a pressure of from 1 to 7 atm abs. by combining distillation and purification in a single stage.

As is well-known, at elevated temperatures during the distilling process reactive sulphur compounds as well as oxygen- and nitrogen-containing compounds are formed. Carbonyl compounds of transition metals or thermal decomposition products thereof combine the reactive compounds so that harmful impurities are transformed into heavy non-volatile components and residues of unreacted volatile treating reagents decompose to metals and gaseous products which do not contaminate the final purified products.

In order to increase the degree of petroleum purification by introducing carbonyl compounds of transition metals thereinto, it is advisable that the system temperature be increased to 250°–350° C. and the system pressure be selected within the range of from 1 to 7 atm. abs. These conditions ensure most effective reaction of volatile carbonyl compounds of transition metals with harmful impurities and decomposition of small amounts of unreacted volatile treating agents.

For the same purpose, when introducing non-volatile carbonyl compounds of transition metals, said compounds may be used in the form of aqueous solutions having a concentration of from 5 to 50% by weight.

As the volatile carbonyl compounds of transition metals it is preferred to employ compounds of the generic formula $M_a(R)_x(CO)_y$, wherein M is V, Cr, Mo, W, Mn, Fe, Re, Co, Ni; a is an integer from 1 to 5; R represents organic liqands such as aromatic, diene, olefine and cyclopentadiene hydrocarbons; x is an integer from 0 to 2; y is an integer from 1 to 12.

As the non-volatile carbonyl compounds of transition metals it is preferred to employ compounds of the formula: $[ML_nM_q(CO)_m]$, wherein M is Ni, Co, Mn, Fe; L is ammonia, pyridine, piperidine, morpholine, γ-picoline, ethylene diamine, monoethanolamine, diethanolamine, triethanolamine and other amines; n is an integer from 2 to 6; m is an integer from 3 to 13; q is an integer from 1 to 4. Use may be also made of salts with carbonylhydride anions of the formula $QH_2Fe_3(CO)_{11}$, where Q is ammonia, monoethanolamine, diethanolamine, triethanolamine, and trialkylamines where the alkyl may be represented by methyl, ethyl, propyl; and n-butylamines.

The process according to the present invention is a one-stage process which enables elimination of not only sulphur-type impurities but nitrogen- and oxygen-containing as well. To eliminate sulphur compounds it is not necessary according to the process of the present invention to transform sulphur to mercaptan sulphur.

Gasoline and kerosene produced according to the process of the present invention contain no hydrogen sulphide or sulphur at all; mercaptan sulphur content is reduced by 5–10 times and total sulphur content is 2 to 10 times reduced; resinous product content is substantially reduced as well. The quality of diesel fuel and bunker fuel (mazout) remains unchanged after treatment with the present process. The octane number of gasoline produced from petroleum as a result of the present process is increased, as a rule, by 10–20 points as compared to octane numbers of gasolines (56–57 by the "motor-method CFR-ASTM") produced from the same petroleum by simple distilling. The present invention is also characterized by a substantial economic efficiency since it enables the production of purified gasolines and kerosene in conventional on-stream distillation units without any substantial changes in the process technology, thus saving production costs for the treatment of resulting petroleum products and freeing corresponding desulphuration unit capacities to be used for the treatment of other petroleum products such as diesel fuel.

BRIEF DESCRIPTION OF THE DRAWINGS

The invention will be better understood from the following description considered together with the accompanying drawings, in which.

DETAILED DESCRIPTION OF THE PREFERRED EMBODIMENTS

The process according to the present invention is performed in the following manner.

Into the petroleum being distilled a carbonyl-containing reagent is gradually introduced at a temperature of from 150° to 350° C. under a pressure of from 1 to 7 atm abs. and petroleum cuts boiling at 10° C. intervals are collected. Thereafter, these fractions are compounded and resulting gasoline, kerosene, diesel fuel and beating fuel (mazout) are subjected to a comprehensive analysis for common characteristics.

Figure 1:
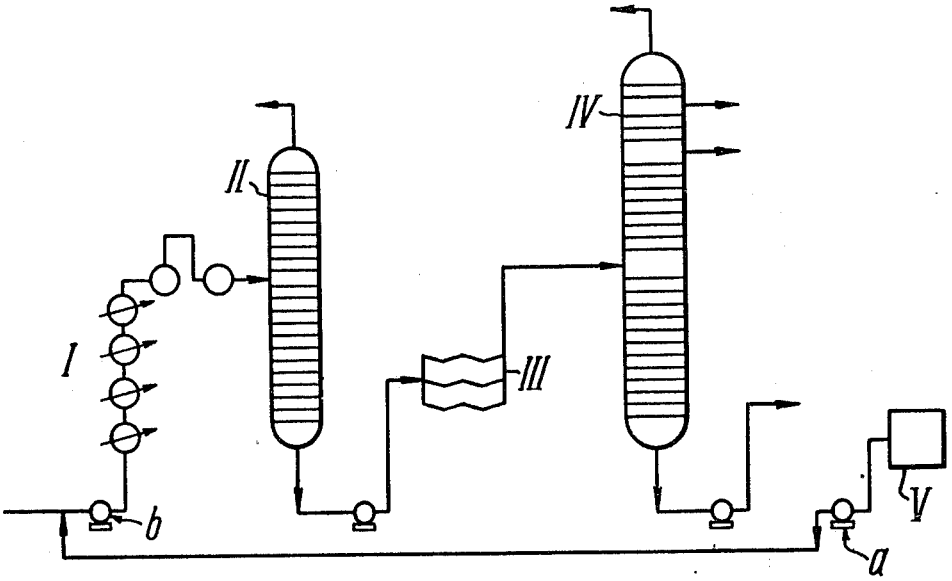
FIGS. 1–4 illustrate a number of forms of the present process in which the treating reagent is fed to various inlet points in the refining system.
Figure 2:
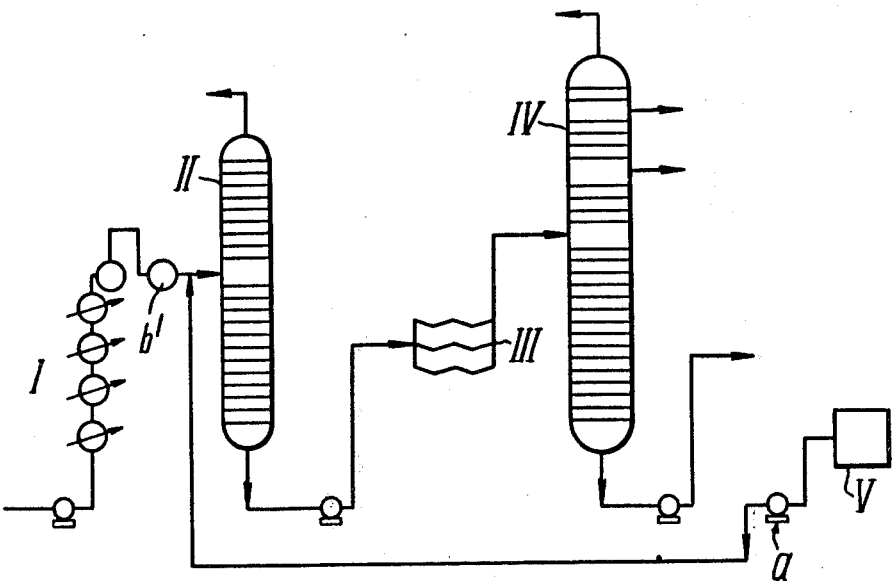
Figure 3:
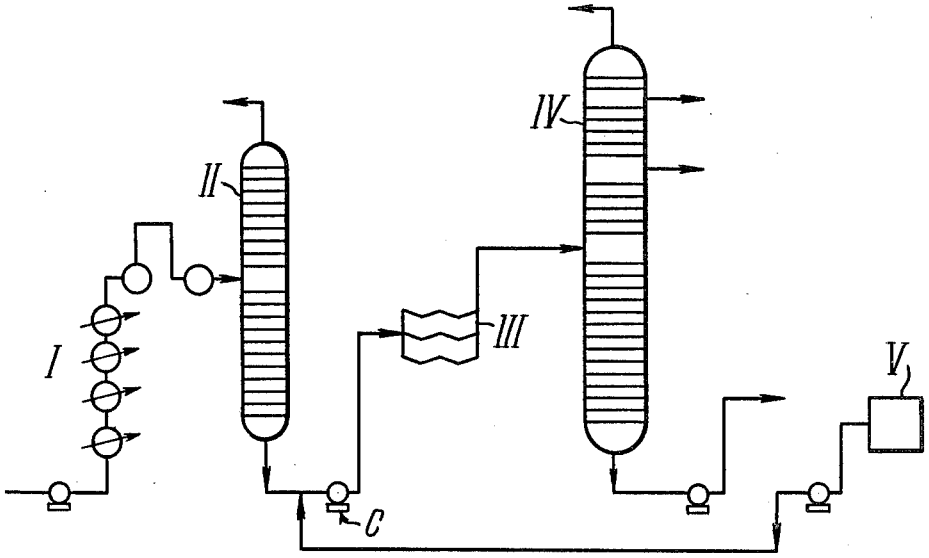
Figure 4:
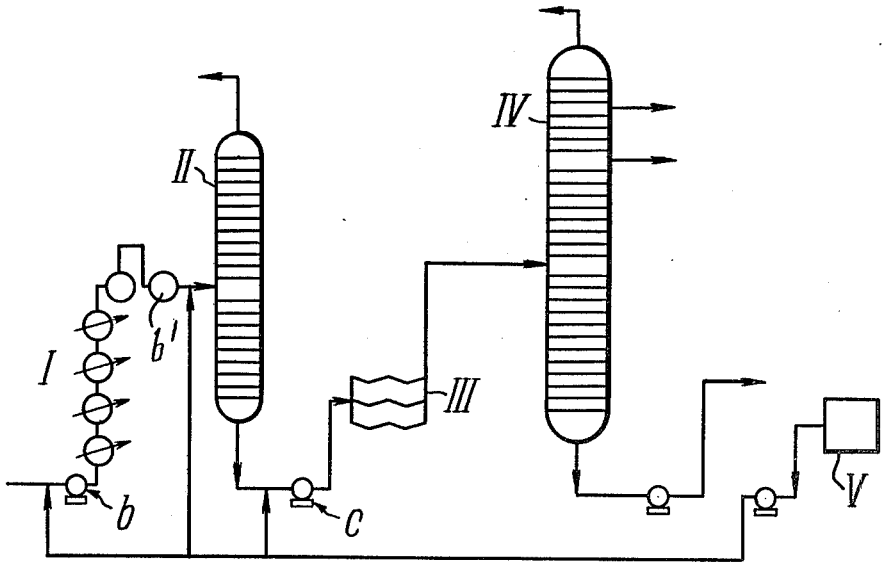

The process of the present invention may be commercially implemented in several forms, depending on the inlet point of the treating reagent (FIGS. 1 to 4): heated petroleum (150° C.) is pumped from heat-exchangers 1 to a column stripper 11, through a pipe still III and then is fed into the main rectification column IV at a temperature of from 250° to 350° C. under a pressure of 1 to 7 atm abs., where rectification is effected.

FIG. I.

A concentrated solution of the reagent in water or the petroleum product prepared by heating in a separate vessel V is pumped by means of a metering pump (a) to the inlet of a charge pump (b) of a distilling unit. Further distillation is performed in a conventional manner.

FIG. II.

A concentrated solution of the reagent in water or the petroleum product prepared by heating in a separate vessel V is pumped by a metering pump (a) to the outlet of a charge pump (b') of a distilling unit. Further distillation is performed in a conventional manner.

In both forms of the process illustrated in FIGS. I and II the reagent may be fed along with a soda solution which is usually introduced into the process to inhibit acid corrosion.

FIG. III.

A concentrated solution of the reagent in a petroleum product prepared in a vessel V is pumped to the inlet of a pipe still pump (c) which delivers hot stripped petroleum from column II to the pipe still III and then to the main rectification column IV. Further distillation is performed in a conventional manner.

FIG. IV.

This figure illustrates a combined system for the reagent supply. A concentrated solution of the reagent in a petroleum product prepared in a vessel V may be fed simultaneously or successively to the inlet of a charge pump (b), to the outlet of a charge pump (b') or to the inlet of a pipe still pump (c). Further refining is performed in a conventional manner.

For a better understanding of the present invention specific examples of the practice of the process are given hereinbelow.

EXAMPLE 1

Into 1,500 g of desalted and dehydrated petroleum being distilled at 350° C. under 1.5 atm. abs., 2.6 g of $[Mn(C_5H_5N)_6]\ [Mn(CO)_5]_2$ salt are gradually added and petroleum cuts boiling at 10° C. intervals are collected. The resulting cuts are compounded to give gasoline (from the initial boiling point to 150° C.), kerosene (150°–230° C.) and diesel fuel (230°–350° C.). The products and distillation bottoms bunker fuel (mazout) are subjected to a comprehensive analysis. Average properties of the resulting fractions are shown in Tables 2 and 3.

EXAMPLE 2

Into 1,500 g of desalted and dehydrated petroleum being distilled at 280° under a pressure of 1.80 atm, 3 g of a salt, i.e. $[(C_2H_5)_3NH_2Fe_3(CO)_{11}]$ are gradually added and 10° C. cuts are collected. These cuts are compounded to give gasoline (from the initial boiling point to 150° C.), kerosene (150°–230° C.) and diesel fuel (230°–350° C.). The products and distillation bottoms bunker fuel (mazout) are subjected to a comprehensive analysis. Average properties of the resulting fractions are shown in Tables 2 and 3.

EXAMPLE 3

Into 1,500 g of a crude petroleum to be distilled at 280° C. under a pressure of 3.5 atm, 1.2 g of manganese carbonyl $Mn_2(CO)_{10}$ is gradually added; 10° cuts are collected and compounded to give gasoline (from the initial boiling point to 150° C.), kerosene (150° to 230° C.) and diesel fuel (230° –350° C.). The products and distillation residue bunker oil (mazout) are subjected to a comprehensive analysis. Average properties of the resulting fractions are shown in Tables 2 and 3.

EXAMPLE 4

Into 700 g of desalted and dehydrated petroleum to be distilled at 300° C. under a pressure of 2.2 atm, 0.8 g of a salt, i.e. $(HOC_2H_4)_3NH_3HFe_3(CO)_{11}$ is gradually added. 10° cuts are collected and, under distillation, fractions of gasoline (from the initial boiling point to 150° C.) and kerosene (150°-230° C.) are separated. The products are subjected to a comprehensive analysis. Average characteristics of the fractions obtained are shown in Tables 2 and 3 hereinbelow.

EXAMPLE 5

Into 1,500 g of a crude petroleum to be distilled at temperature of 300° C. under 4 atm abs. pressure, 2 g of iron pentacarbonyl are added; 10° cuts are collected and compounded to give gasoline (from the initial boiling point to 150° C.), kerosene (150°-230° C.) and diesel fuel (230°-350° C.). The products and distillation residue bunker fuel (mazout) are subjected to a comprehensive analysis. Average characteristics of the fractions obtained are shown in Tables 2 and 3.

Examples 6 through 22 are given in Table 1. Petroleum refining is performed in a manner similar to that described in the foregoing Example 3. Average characteristics of the fractions obtained are shown in Table 2.

Table 1

| Conditions of petroleum refining (Examples 6 through 22) | | | | | | |
|---|---|---|---|---|---|---|
| No. 1 | Petroleum amount, g 2 | Carbonyl reagent 3 | Carbonyl reagent amount, g 4 | Temperature, ° C 5 | Time, min 6 | Pressure, atm. absol. 7 |
| 6 | 1,000 | $Cr(CO)_6$ | 0.6 | 250 | 45 | 3.5 |
| 7 | 1,800 | $Mo(CO)_6$ | 1.3 | 300 | 40 | 3.5 |
| 8 | 1,200 | $W(CO)_6$ | 1.3 | 300 | 40 | 3.5 |
| 9 | 1,500 | $Co_2(CO)_8$ | 1.6 | 280 | 35 | 3.5 |
| 10 | 1,500 | $Ni(CO)_4$ | 1.6 | 280 | 35 | 4 |
| 11 | 1,500 | $Re(CO)_{10}$ | 1.1 | 300 | 40 | 2 |
| 12 | 2,000 | $Mo(CO)_6$, 1:1 $Fe(CO)_5$ (wt) | 2 | 280 | 35 | 4 |
| 13 | 2,000 | $Ni(CO)_4$ 1:1 $Co_2(CO)_8$ (wt) | 2 | 280 | 35 | 4 |
| 14 | 2,000 | $Cr(CO)_6$ $CO_2(CO)_8$ 1:1 | 2 | 280 | 35 | 3.5 |
| 15 | 1,700 | $Fe_2(CO)_9$ | 1.7 | 300 | 40 | 2.5 |
| 16 | 1,700 | $Fe_3(CO)_{12}$ | 1.7 | 300 | 40 | 2.5 |
| 17 | 1,500 | $C_6H_6Cr(CO)_3$ | 1.3 | 250 | 40 | 1.5 |
| 18 | 1,500 | $C_5H_6Fe(CO)_3$ | 1.6 | 280 | 45 | 1.5 |
| 19 | 1,500 | $C_4H_6Fe(CO)_3$ | 1.1 | 250 | 35 | 1.5 |
| 20 | 1,800 | $C_6H_8Fe(CO)_3$ | 1.2 | 250 | 40 | 1.5 |
| 21 | 1,500 | $C_5H_5Co(CO)_2$ | 1.3 | 250 | 40 | 1.5 |
| 22 | 1,700 | $C_5H_5Mn(CO)_3$ | 1.4 | 250 | 40 | 1.5 |

*See R. K. Kochhav et al, Journal Organometal. Chemistry, Vol. 6, p. 272 (1966).

Table 2

| Characteristics of petroleum fractions produced from desalted petroleum with and without introduction of a treating agent into the petroleum being refined, | | | | | | | | |
|---|---|---|---|---|---|---|---|---|
| | Petroleum fractions obtained without introduction of a purifying agent | | | | Petroleum fraction obtained with introduction of a purifying agent | | | |
| Characteristics initial 1 | Gasoline fraction boiling point to 150° C 2 | Kerosene fraction 150 to 230° C 3 | Diesel fuel fraction 230 to 350° C 4 | Distillation bottoms, (bunker fuel) above 350° C 5 | Gasoline fraction initial boiling point to 150° C 6 | Kerosene fraction 150-230° C 7 | Diesel fuel 230 to 350° C 8 | Distillation bottoms (bunker fuel) above 350° C 9 |
| Octane number "Motor-method" (CFR-ASTM) | 56.0-57.0 | — | — | — | 80-86 | — | — | — |
| Content, wt.%: | | | | | | | | |
| total sulphur | 0.03-0.02 | 0.15-0.16 | 1.20-1.18 | 2.30 | 0.01-0.002 | 0.15-0.07 | 1.13-1.15 | 2.35 |
| mercaptan sulphur | 0.0056-0.0050 | 0.0045-0.0050 | 0.0014-0.0013 | — | 0.002-0.001 | 0.0007-0.0002 | 0.0010-0.0011 | — |
| hydrogen sulphide sulphur | 0.0016-0.0020 | 0.0003-0.0005 | none | | none | none | none | — |
| Density $\rho^{40}_4$, g/cm$^3$ | 0.690-0.700 | 0.775-0.778 | — | — | 0.690-0.700 | 0.775-0.778 | — | — |
| Kinematic viscosity at 20° C, cSt | — | 1.25-1.27 | 5.0-6.0 | — | — | 1.25-1.27 | 5.0-6.0 | — |
| Combustion heat, Kcal/kg | — | 10,400-10,430 | — | — | — | 10,400-10,425 | — | — |
| Smoke point, mm | — | 25-27 | — | — | — | 26-28 | — | — |
| Acidity, mg KOH per 100 ml of fuel | — | — | — | — | 1.60-1.70 | 0.5-0.7 | — | — |
| Flash point, ° C | — | 28-30 | 85-90 | — | — | 28-30 | 85-90 | — |
| Congelation point (pour point) ° C | — | 60-62 | 10-15 | — | — | 60-62 | 10-15 | — |

Table 2-continued

| Characteristics initial 1 | Characteristics of petroleum fractions produced from desalted petroleum with and without introduction of a treating agent into the petroleum being refined, Petroleum fractions obtained without introduction of a purifying agent: Gasoline fraction boiling point to 150° C 2 | Kerosene fraction 150 to 230° C 3 | Diesel fuel fraction 230 to 350° C 4 | Distillation bottoms, (bunker fuel) above 350° C 5 | Petroleum fraction obtained with introduction of a purifying agent: Gasoline fraction initial boiling point to 150° C 6 | Kerosene fraction 150–230° C 7 | Diesel fuel 230 to 350° C 8 | Distillation bottoms (bunker fuel) above 350° C 9 |
|---|---|---|---|---|---|---|---|---|
| Iodine number, g per 100 g of fuel | — | 0.3–0.4 | — | — | — | 0.3–0.5 | — | — |
| Mechanical impurities content, mg | none | none | — | — | none | none | — | — |
| Ash content, wt.% | — | 0.001–0.003 | — | — | — | 0.002–0.003 | — | — |

Table 3

Characteristics of bunker fuel obtained by using bottoms of petroleum distillation and introducing, into the crude petroleum, carbonyl reagents according to Examples 1–3 and 4–5. Weight ratio between diesel fuel and bottoms is 1:1.

| No. | Characteristics | Average values: Examples 1–3 | Examples 4–5 |
|---|---|---|---|
| 1 | Engler viscosity at 50° C, degrees | 2.38–2.40 | 2.85–2.90 |
| 2 | Ash content, % by weight | 0.038–0.05 | 0.049–0.060 |
| 3 | Mechanical impurities content, % by weight | 0.010–0.013 | 0.092–0.097 |
| 4 | Water content, % by weight | none | none |
| 5 | Content of water-soluble acides and alkalis | none | none |
| 6 | Sulphur content, % by weight | 1.50–1.52 | 1.51–1.54 |
| 7 | Hydrogen sulphide content | none | none |
| 8 | Gums content, % by weight | 48–50 | 48–50 |
| 9 | Flash point (closed crucible), ° C | 82–84 | 84–86 |
| 10 | Congelation point, ° C | −9 to −7 | −11 to −9 |
| 11 | Density, $d_4^{20}$ | 0.898 | 0.898 |

What is claimed is:

1. A process for petroleum refining to obtain petroleum products having a reduced content of sulphur, oxygen, and nitrogen-containing compounds which comprises introducing into the petroleum being distilled a non-volatile carbonyl compound of the formula $ML_nM_q(CO)_m$, where M is a transition metal selected from the group consisting of Ni, Co, Mn and Fe; L is an amine selected from the group consisting of ammonia, pyridine, piperidine, morpholine, γ-picoline, ethylene diamine, monoethanolamine, diethanolamine and triethanolamine; n is an integer from 2 to 6; m is an integer from 3 to 13; and q is an integer from 1 to 4; in an amount of from 0.02 to 0.2% by weight of the petroleum at a temperature ranging from 150° to 350° C. under a pressure of from 1 to 7 atm absolute to distill said petroleum into said desired products.

2. A process for petroleum refining to obtain petroleum products having a reduced content of sulphur, oxygen and nitrogen-containing compounds which comprises introducing into the petroleum being distilled a non-volatile carbonyl compound of the formula $QH_2Fe_3(CO)_{11}$, where Q is an amine selected from the group consisting of ammonia, monoethanolamine, diethanolamine, triethanolamine and trialkylamines; in an amount of from 0.02 to 0.2% by weight of the petroleum at a temperature ranging from 150° to 350° C. under a pressure of from 1 to 7 atm absolute to distill said petroleum into said desired products.

3. A process for petroleum refining to obtain petroleum products having a reduced content of sulphur, oxygen and nitrogen-bearing compounds which comprises introducing into the petroleum being distilled a carbonyl compound of the formula $M_aR_x(CO)_y$, where M is a transition metal selected from the group consisting of V, Cr, Mo, W, Re, Fe, Co and Ni; a is an integer from 1 to 5; R is an organic ligand selected from the group consisting of aromatic, diene, olefine and cyclopentadiene hydrocarbons, x is an integer from 0 to 2; and y is an integer from 1 to 12; in an amount of from 0.02 to 0.2% by weight of the petroleum at a temperature ranging from 150° to 350° C. under a pressure of from 1 to 7 atm absolute to distill said petroleum into said desired products.

* * * * *